US005290997A

United States Patent [19]

Lai et al.

[11] Patent Number: 5,290,997

[45] Date of Patent: Mar. 1, 1994

[54] ROTARY ELECTRIC STOVE FOR HEATING AND WARMING FOOD AT A TABLE

[76] Inventors: Yu-Jen Lai, c/o Hung Hsing Patent Service Center, P.O. Box 55-1670, Taipei (10477); Shih-Wen Li, c/o Hung Hsing Patent Service Center, P.O. Box 55-1670, Taipei (104), both of Taiwan

[21] Appl. No.: 980,584

[22] Filed: Nov. 23, 1992

[51] Int. Cl.[5] ..... H05B 1/00

[52] U.S. Cl. ..... 219/218; 219/385; 219/433; 219/521

[58] Field of Search ..... 219/432, 433, 521, 520, 219/217, 218, 385, 386, 387, 443

[56] References Cited

U.S. PATENT DOCUMENTS

| | | | |
|---|---|---|---|
| 1,120,758 | 12/1914 | Stirn | 219/218 |
| 1,158,475 | 11/1915 | Fox | 219/218 |
| 2,061,637 | 11/1936 | Schulz | 219/218 X |
| 2,897,330 | 7/1959 | Hopkins | 219/218 |
| 3,636,299 | 1/1972 | Stewart | 219/218 X |
| 4,034,200 | 7/1977 | Visagie | 219/218 |
| 5,077,460 | 12/1991 | Rocha et al. | 219/218 X |

FOREIGN PATENT DOCUMENTS

| | | | |
|---|---|---|---|
| 1556796 | 11/1979 | United Kingdom | 219/218 |

*Primary Examiner*—Anthony Bartis

[57] ABSTRACT

A rotary stove for warming food items being served at a table has a tray mounted on a base for rotation about a vertical axis and includes a central protrusion supporting a hot plate surrounded by a plurality of peripheral vessels removably seated in the tray. The tray has a first electric heater in contact with the hot plate and a plurality of second electric heaters each contacting respective ones of the removable vessels. The heaters are connected to a power supply by cooperating slip rings and brushes on the tray and base. A pot may be placed on the hot plate to be heated and different foods placed in the vessels for warming may be conveniently chosen by rotation of the tray. Alternatively, the plurality of removable vessels may be replaced by a single annular vessel in contact with the second heaters.

5 Claims, 4 Drawing Sheets

ROTARY ELECTRIC STOVE FOR HEATING AND WARMING FOOD AT A TABLE

BACKGROUND OF THE INVENTION

In a table serving dinner foods or dishes for a plurality of guests in a dinner party or for customers such as a group of the families or business colleagues in a restaurant, the foods especially the diversified Chinese foods once placed on the table will become cool to influence its delicous flavor or taste unless being frequently warmed by alcohol burner or other heating methods, causing a very inconvenient dinner service.

Even a chafing dish may be provided on the table for keeping the foods warm for the guests sitting around the table, the so many kinds of foods present on the table may require a plurality of chafing dishes for warming the foods, still causing an inconvenient dinner service. Meanwhile, it may embarrass the guest to pick up his or her preferred foods among the so many dishes, unless the table is made as a rotatable table.

Therefore, the present inventor invents a rotary stove for overcoming the aforementioned drawbacks of a conventional dinner arrangement.

SUMMARY OF THE INVENTION

The object of the present invention is to provide a rotary electric stove including a base, and a rotatable tray detachably laid with a plurality of cooking or heating elements such as a pan, a cooking vessel, a dish or a pot on the rotatable tray which is rotatably mounted on the base, with the cooking or heating elements electrically connected with a power source to be heated or warmed by the power source, so that the foods, soup or beverage stored on the plural cooking or heating elements may be heated or warmed and may be rotatably chosen by an eater for a convenient and comfortable table foods or drinks service.

DETAILED DESCRIPTION

Figure 1:
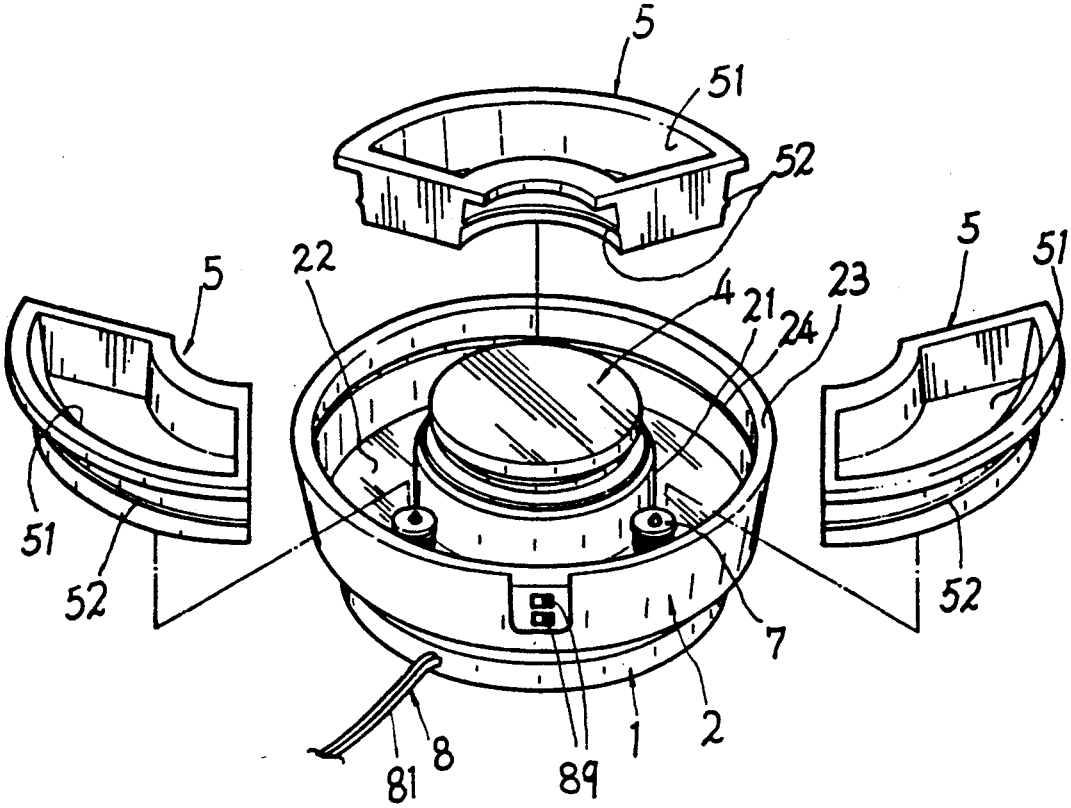
FIG. 1 is a perspective view of the present invention.
Figure 2:
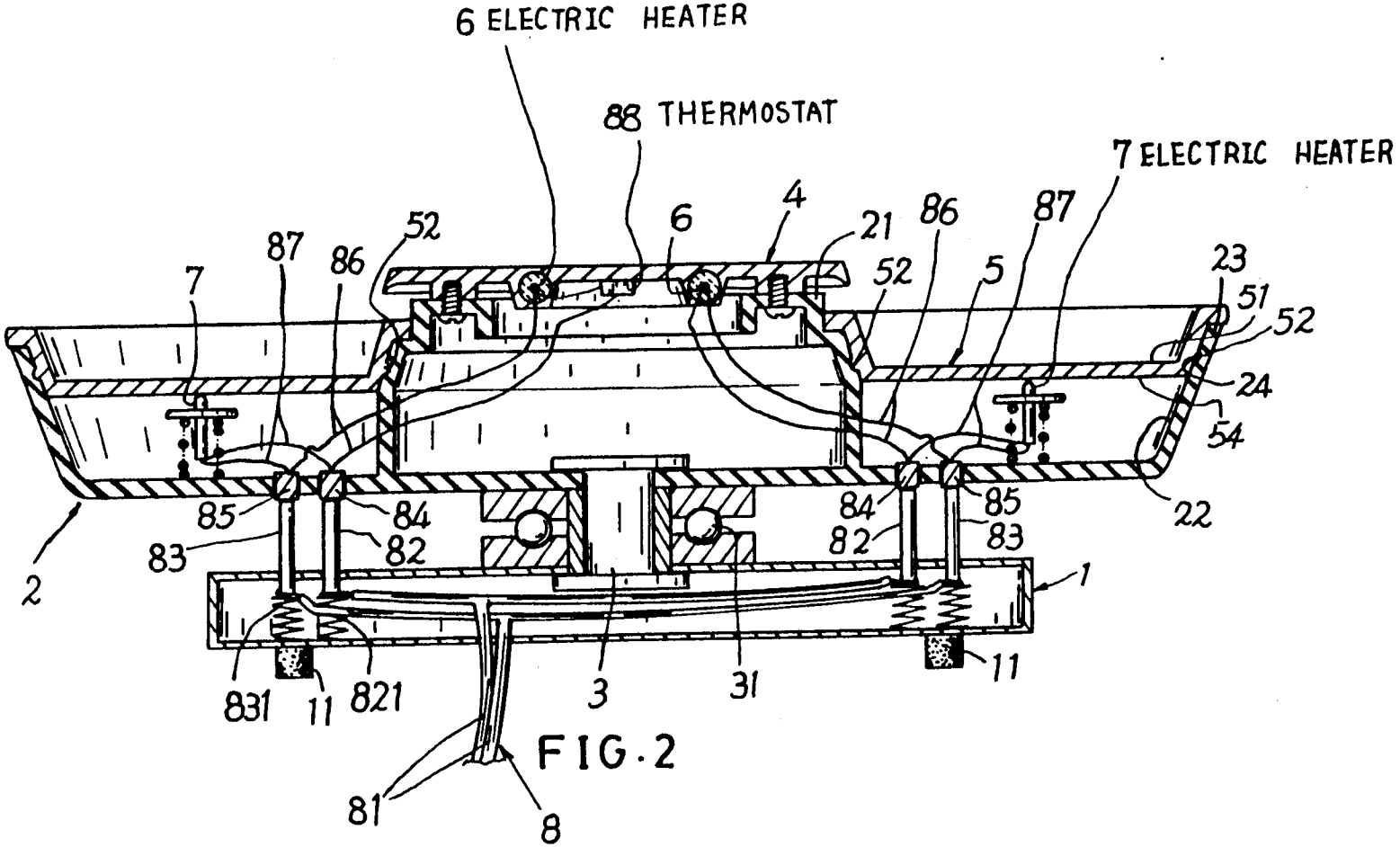
FIG. 2 is a section drawing of the present invention.
Figure 3:
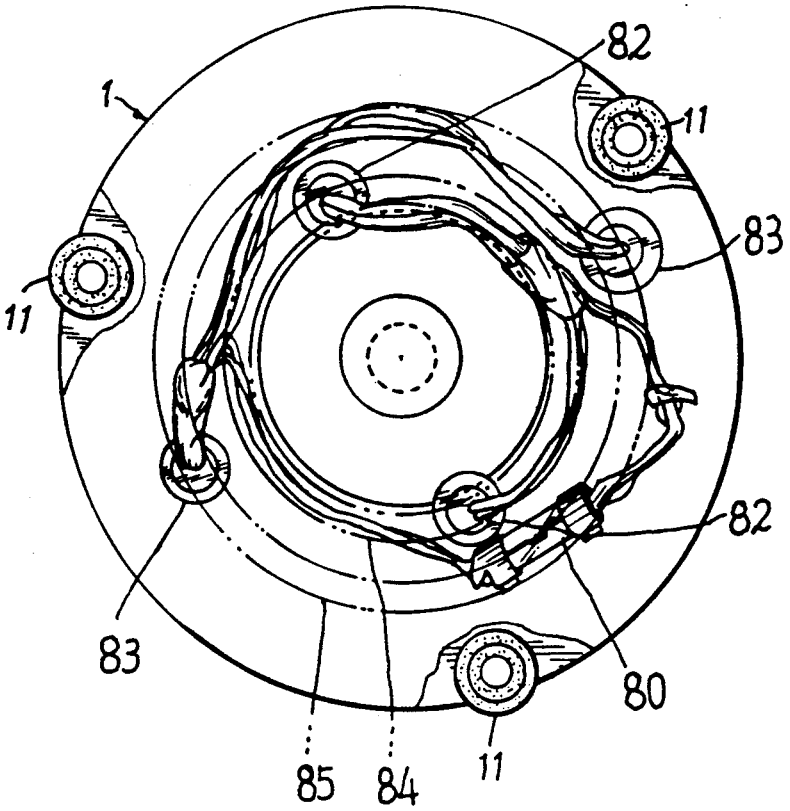
FIG. 3 is a partial cut-away bottom view of the present invention.

As shown in FIGS. 1-3, the present invention comprises: a base 1, a rotatable tray 2, a central shaft 3, a central hot plate 4 formed on a central upper portion of the rotatable tray 2, at least a peripheral vessel 5 disposed around the central hot plate 4, a first heater 6 and a second heater 7 respectively connected to a power source 8 for heating or warming the hot plate 4 and the peripheral vessel 5.

Figure 4:
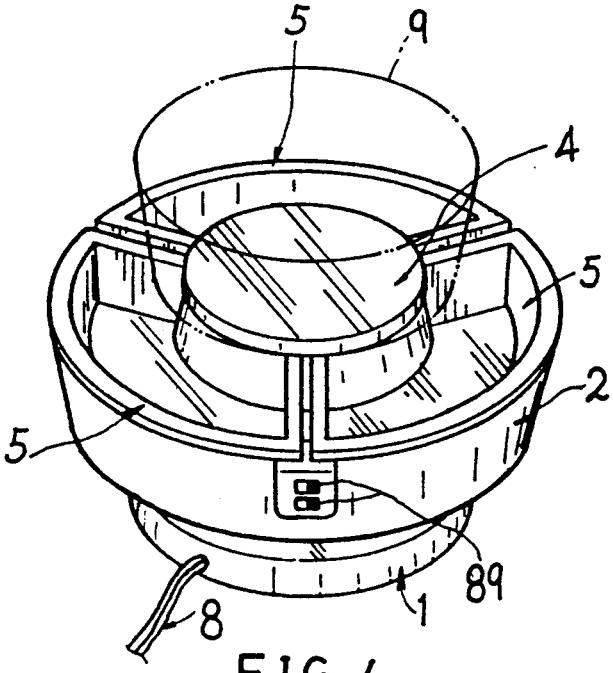
FIG. 4 is an illustration showing an application when using the present invention.

A pot 9 as shown in FIG. 4 may be laid on the central hot plate 4 for cooking or boiling foods, soup or water in the pot.

The base 1 has a plurality of supporting legs 11 for standing the base on a table surface, having the central shaft 3 protruding upwardly from a central portion of the base 1.

The rotatable tray 2 rotatably mounted on the base 1 about the shaft 3 includes: a central protrusion 21 protruding upwardly from a central portion of the tray 2, an outer peripheral extension 23 circumferentially formed an outer edge portion of the tray 2, and an annular recess portion 22 annularly recessed in the tray 2 between the outer peripheral extension 23 and the central protrusion 21.

A pair of annular grooves 24 are annularly recessed respectively in the central protrusion 21 and in the outer peripheral extension 23.

The central shaft 3 is surrounded by a bearing 31 between the rotatable tray 2 and the base 1 for smoothly rotating the tray 2 about the shaft 3 on the base 1.

The central pan 4 may be formed as a horizontal plate fixed on the central protrusion 21 or formed with a shallow recess in a central portion of the pan 4 adapted for laying a pot 9 or a tea pot **9*a* (FIG. 5) or other cooking or heating containers on the pan 4**.

A plurality of peripheral vessels 5 detachably laid on the rotatable tray 2, each peripheral vessel 5 generally shaped as an arcuate sector including a cavity 51 recessed in the vessel for storing foods, vegetables, or even soup in the cavity, and a pair of arcuate rim extensions 52 arcuately formed on an inner and an outer side wall of the vessel 5 engageable with the pair of annular grooves 24 formed in the disc 2 to stably seat each vessel 5 in said annular recess portion 22 recessed in the rotatable tray 2

The peripheral vessel 5 may also be formed as a single annular vessel 5 disposed around the central protrusion 21 instead of the plural sector-shaped arcuate vessels as shown in FIG. 1.

The power source 8 includes: a main cord 81 connected to a municipal power supply source, at least a pair of carbon brushes 82, 83 electrically connected to two electric wires of two poles of the main cord 81 with the carbon brushes 82, 83 secured on two springs 821, 831 mounted in the base 1 for resiliently contacting a pair of electrically conductive slip rings 84, 85 concentrically fixed in a bottom portion of the rotatable tray 2, at least two first output electric wires 86 electrically connected to a first heater 6 secured to a bottom of the pan 4, which may be an electric heating coil and connected to the pair of carbon brushes 82, 83 for leading municipal power supply to the first heater 6 for heating, roasting foods directly put on the central plate 4 or for indirectly heating a medium filled in the pot 9 or **9*a* laid on the plate 4, at least two second output electric wires 87 electrically connected to a second heater 7 which may also be an electric heating coil contacting a bottom of the peripheral vessel 5, and connected to the pair of carbon brushes 82, 83, at least a thermal control switch or thermostat 88 provided in the wires 86, 87 for controlling temperature of the heaters 6, 7, and a main switch 89 for on-off control of the power source and for selectively actuating either the first or the second heater 6 or 7 or both heaters 6, 7**.

A fuse (not shown) may also be provided in the wires 86, 87 for breaking power supply to the heaters 6, 7 for electrical safety reason.

The shapes, structures and arrangements of the hot plate 4, vessels 5, heaters 6, 7, pots 9, **9*a*** or dishes (not shown) are not limited in this invention. They can be modified without departing from the spirit and scope of this invention as hereinafter claimed.

In a dinner, the plural vessels 5 may be filled with diversified foods or vegetables and cooked or warmed by the heaters 7, and a central pot 9 such as filled with soup can be held on the central hot plate 4 for boiling or warming the soup for serving warm foods or soup for the guests. The guest can rotate the tray 2 about the shaft 3 on base 1 for selecting his or her preferred kind of food for a convenient pick-up and eating of the food.

The vessels 5 and the hot plate 4 may also serve for roasting meat or foods for barbeque purpose.

Accordingly, this invention provides a stove having multiple purposes for effectively heating, warming, cooking, or boiling purposes and for operatively rotating the tray convenient eating or drinking selections.

Figure 5:
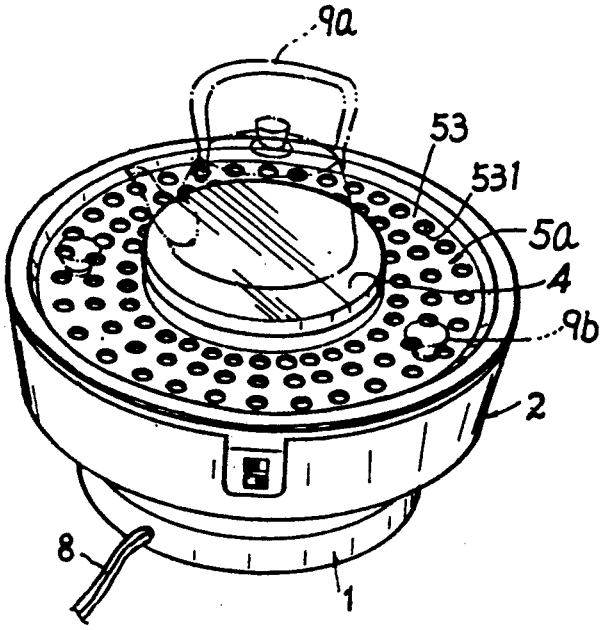
FIG. 5 is a perspective view shows another preferred embodiment of the present invention.
Figure 6:
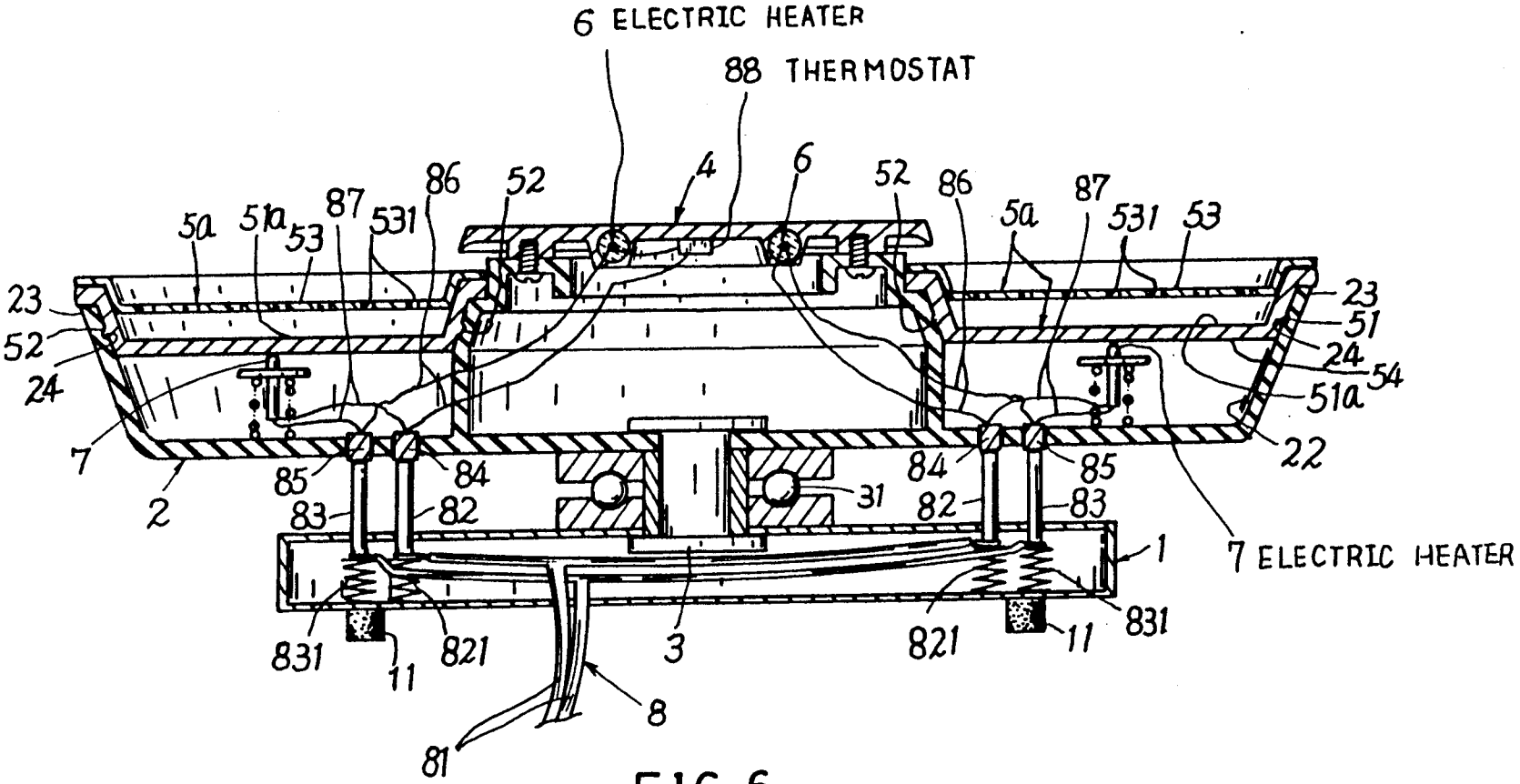
FIG. 6 is a sectional drawing of the present invention as shown in FIG. 5.

Another preferred embodiment of the present invention is shown in FIGS. 5, 6, in which the peripheral vessel 5 is modified to be a single peripheral vessel 5*a* annularly disposed around the central protrusion 21 of the rotary tray 2 having an annular cavity 51*a* annularly recessed in the vessel 5*a* with a bottom plate 54 formed on a bottom of the cavity 51*a*, and an upper plate 53 annularly formed on an upper portion of the cavity 51*a* above the bottom plate 54 having a plurality holes 531 formed through the upper plate 53 for draining water through the holes 531 to be collected on the bottom plate 54 of the cavity 51*a* by placing tea cup 9*b*, for instance, on the upper plate 53.

By the way, a tea pot 9*a* may be placed on the central hot plate 4 for heating the pot 9*a* filled with tea (water) in the pot 9*a* and the tea cups 9*b* may be placed on the upper plate 53. Both pot 9*a* and cups 9*b* may be heated or warmed on the stove of the present invention for making tea for drinking purpose. Durng tea making process, the water for warm-washing the cup 9*b* may be poured into the cavity 51*a* by draining water through the holes 531 formed in the upper plate 53.

The rotary stove of the present invention may be proportionally enlarged to simulate a rotary dining table for a convenient dining purpose.

I claim:

1. A rotary electric stove comprising: a base, and a rotatable tray having a central hot plate and a plurality of peripheral vessels disposed around the central hot plate and detachably seated in the rotatable tray which is rotatably mounted on the base for rotation about a vertical axis, said tray having a plurality of first and second heaters electrically connected with a power source, with each said first heater contacting said central hot plate for heating the central hot plate and each said second heater contacting each said peripheral vessel for heating the peripheral vessel, so that foods, soup, and beverage filled in the plural vessels and filled in a pot placed on the central hot plate will be heated and be rotatably chosen by an eater by rotating the tray on the base for a convenient and comfortable table service.

2. A stove according to claim 1, wherein said rotatable tray rotatably mounted on the base about a shaft includes: a central protrusion protruding upwardly from a central portion of the tray, an outer peripheral extension circumferentially formed on an outer edge portion of the tray, and an annular recess portion annularly recessed in the tray between the outer peripheral extension and the central extension.

3. A stove according to claim 1, wherein each peripheral vessel is detachably laid on the rotatably tray, and is generally shaped as an arcuate sector including a cavity recessed in the vessel for storing foods, vegetables, or soup in the cavity, and a pair of arcuate rim extensions arcuately formed on an inner and an outer side wall of the vessel engageable with a pair of annular grooves formed in the tray to stably seat each said vessel in an annular recess portion recessed in the rotatable tray.

4. A stove according to claim 1, wherein said power source includes: a main cord connected to a municipal power supply source, at least a pair of carbon brushes electrically connected to two electric wires of two poles of the main cord with the carbon brushes secured on two springs mounted in the base for resiliently contacting a pair of electrically conductive slip rings concentrically fixed in a bottom portion of the rotatable tray, at least two first output electric wires electrically connected to a first heater secured to a bottom of the hot plate, and connected to the pair of slip rings for leading municipal power supply to the first heater for heating, roasting foods directly put on the central hot plate or for indirectly heating a medium filled in the pot laid on the hot plate, at least two second output electric wires electrically connected to a second heater contacting a bottom of the peripheral vessels, and connected to the pair of slip rings, at least a thermal control switch provided in the wires for controlling temperature of the heaters, and a main switch for on-off control of the power source and for selectively actuating the heaters.

5. A stove comprising:

a base, and a rotatable tray having a central hot plate and a peripheral vessel disposed around the central hot plate and detachably seated in the rotatable tray which is rotatably mounted on the base for rotation about a vertical axis, having a plurality of first and second heaters electrically connected with a power source, with each said first heater contacting said central hot plate for heating said hot plate and each said second heater contacting said peripheral vessel for heating the peripheral vessel, said peripheral vessel annularly disposed around a central protrusion of the rotatable tray and having an annular cavity annularly recessed in the vessel with a bottom plate forming the bottom of the cavity, and an upper plate annularly formed on an upper portion of the cavity above the bottom plate having a plurality of holes formed through the upper plate for draining water through the holes to be collected on the bottom plate of the cavity, whereby a cup may be placed on the upper plate for warming said cup, and a pot may be placed on the central hot plate for heating the pot.

* * * * *